US005700162A

United States Patent [19]

Hatagishi et al.

[11] Patent Number: 5,700,162

[45] Date of Patent: Dec. 23, 1997

[54] CONNECTOR

[75] Inventors: Yuji Hatagishi; Toshihiko Yamamoto; Kimihiro Abe; Toshiaki Okabe, all of Shizuoka-ken, Japan

[73] Assignee: Yazaki Corporation, Tokyo, Japan

[21] Appl. No.: 658,413

[22] Filed: Jun. 5, 1996

[30] Foreign Application Priority Data

Jun. 6, 1995 [JP] Japan ..... 7-139275

[51] Int. Cl.[6] ..... H01R 13/40

[52] U.S. Cl. ..... 439/595; 439/603; 439/752

[58] Field of Search ..... 439/593, 603, 439/752, 595

[56] References Cited

U.S. PATENT DOCUMENTS

| | | | |
|---|---|---|---|
| 3,990,759 | 11/1976 | Crowe | 439/595 OR |
| 4,705,337 | 11/1987 | Maeda | 439/595 OR |
| 4,721,482 | 1/1988 | Fukuda et al. | 439/595 OR |
| 5,147,222 | 9/1992 | Hotea et al. | 439/752 X |

FOREIGN PATENT DOCUMENTS

| | | |
|---|---|---|
| 61-103878 | 7/1986 | Japan . |
| 61-119285 | 7/1986 | Japan . |
| 61-161976 | 10/1986 | Japan . |
| 4-42070 | 4/1992 | Japan . |

*Primary Examiner*—P. Austin Bradley
*Assistant Examiner*—Daniel Wittels
*Attorney, Agent, or Firm*—Finnegan, Henderson, Farabow, Garrett & Dunner, L.L.P.

[57] ABSTRACT

A connector includes an opening which is formed in the outer peripheral wall of a connector housing and faces a terminal storage chamber, a rear holder arranged in the opening and inserted into the terminal storage chamber to be engaged with an engagement portion of a terminal inserted into the terminal storage chamber from the rear so as to prevent removal of the terminal to the rear, and front and rear plastic bands for connecting the front and rear edges of the rear holder to the front and rear edges of the opening. A curved spring portion for pivotally holding the rear holder on the front end of the front plastic band with keeping the posture of the rear holder at this time constant is formed on the rear plastic band.

4 Claims, 2 Drawing Sheets

CONNECTOR

BACKGROUND OF THE INVENTION

Field of the Invention

The present invention relates to a connector in which a rear holder for preventing removal of a terminal is integrated with a connector housing.

Description of the Related Art

Japanese Unexamined Utility Model Publication No. 61-119285 describes a conventional connector (first prior art).

In this connector, when a terminal is inserted into a terminal storage chamber arranged in a connector housing from the rear, a lance formed on the inner wall of the terminal storage chamber is engaged with a head portion of the terminal. In this manner, the terminal can be prevented from being removed from the terminal storage chamber.

A recessed portion is formed in an outer peripheral wall (upper wall) of the connector housing, and an opening which faces the terminal storage chamber is formed in the bottom portion of the recessed portion. A rear holder for double-engaging the terminal is arranged outside the recessed portion. Both the sides of the rear holder are supported by plastic bands, so that an engagement projection extending from the lower surface of the rear holder can be inserted into the terminal storage chamber from the opening.

The engagement projection is to be engaged with the rear end of the head portion of the terminal inserted into the terminal storage chamber. An inclined surface which moves the terminal forward by bring the rear corner portion of the head portion of the terminal at an incompletely insertion position into slidable contact with the inclined surface is formed on the front surface side of the engagement projection. Engagement portions 10 and 11 for holding the rear holder which is inserted into the recessed portion are formed on the inner wall of the recessed portion and the front and rear walls of the rear holder.

In this connector, when the engagement projection of the rear holder is inserted into the opening while the terminal is at an incomplete insertion position, the inclined surface on the front side of the engagement projection collides with the rear end corner portion of the head portion of the terminal. Therefore, when the rear holder is directly pressed into the recessed portion, the terminal can be pressed to reach a normal engagement position in front of the terminal by the function of the inclined surface. After the terminal is pressed, the rear holder is held at this position by the function of the engagement portions. Therefore, removal of the terminal can be prevented by the rear holder.

Japanese Unexamined Utility Model Publication No. 61-103878 describes another conventional connector (second prior art).

In this connector, a lance for actual engagement is formed inside the terminal storage chamber of the connector housing, and an opening is formed in an outer peripheral wall. An engagement projection of a rear holder is formed outside the opening. In this case, the rear holder is constituted by a plate-like member, and the front end edge of the rear holder is integrated with the connector housing by an hinge. An inclined surface is formed on the front side of the engagement projection, and engagement portions for locking the rear holder are formed on the rear end surface of the rear holder and the outer peripheral wall of the connector housing.

In this connector, when a terminal is in an incomplete insertion state, and the rear holder is pivoted on the hinge, the engagement projection is inserted from the opening into the terminal storage chamber, and the inclined surface of the engagement projection collides with the rear end corner portion of the head portion of the terminal, so that the terminal is pressed forward by the function of the inclined surface.

After the terminal is pressed into the terminal storage chamber, the rear holder is held at this position by the function of the engagement portions. For this reason, removal of the terminal can be prevented by the rear holder.

Japanese Unexamined Utility Model Publication No. 4-42070 describes still another conventional connector (third prior art).

In this connector, an opening which faces a terminal storage chamber is formed in the outer peripheral wall of a connector housing, and an engagement projection of the rear holder is formed outside the opening. In this case, a rear holder is constituted by a plate-like member, and the rear holder is integrated with the connector housing by string-like elastic members which are arranged on both the side of the rear holder and can be freely bent. Two string-like elastic members are parallelly arranged on each side. While the rear holder is kept parallel by the principle of a parallel link, the string-like elastic members support the connector housing in such a manner that the connector housing can be moved forward/backward and upward/downward. An engagement piece is formed to extend from the front end of the engagement projection. While the engagement projection is inserted into the opening, when the rear holder is moved forward, the engagement piece is engaged with the edge of the opening to prevent removal of the rear holder.

In this connector, when a terminal is inserted into the terminal storage chamber, the rear holder is moved forward and downward, and the engagement projection is inserted into the opening. When the rear holder is further slid forward, the terminal which is in an incomplete insertion state is pressed by the engagement piece to move to a normal engagement position, so that the engagement piece is engaged with the edge portion of the opening.

According to either of the first and second prior arts, the terminal is pressed by the sliding function of the inclined surface formed in the engagement projection. However, the inclined surface is brought into contact with the rear end corner portion of the head portion of the terminal, the terminal may bite into the rear holder consisting of a resin. In fact, the terminal may not be moved to the normal position.

According to the third prior art, the rear holder is supported by the string-like elastic members arranged in the form of parallel links. For this reason, when the engagement projection is inserted into the opening, the rear holder can be slightly moved forward. Therefore, when the terminal is located at an incomplete insertion position in back of the terminal, the terminal can be caught by the engagement piece, and the terminal may not be reliably pressed to reach the normal engagement position.

In either of the prior arts, since the rear holder is arranged outside the outer peripheral wall of the connector housing, other members may disadvantageously collide with the rear holder or members for supporting the rear holder.

SUMMARY OF THE INVENTION

The present invention has been made in consideration of the above circumstances, and has as its object to provide a connector in which a terminal which is at an incomplete insertion position can be reliably pressed by a rear holder to reach a normal engagement position, and other members does not disadvantageously collide with the rear holder.

According to the first aspect of the present invention, there is provided a connector comprising an opening which is formed in the outer peripheral wall of a connector housing and faces a terminal storage chamber, a rear holder arranged in the opening and inserted into the terminal storage chamber to be engaged with an engagement portion of a terminal inserted into the terminal storage chamber from the rear so as to prevent removal of the terminal to the rear, and front and rear plastic bands for connecting the front and rear edges of the rear holder to the front and rear edges of the opening, wherein a curved spring portion for pivotally holding the rear holder on the front end of the front plastic band with keeping the posture of the rear holder at this time constant is formed on the rear plastic band.

According to the second aspect of the present invention, in the connector, when the rear holder is pressed to reach a predetermined position in the terminal storage chamber, an engagement portion for holding the rear holder is arranged at the predetermined position.

According to the third aspect of the present invention, in the connector, a curved spring portion is formed on the front plastic band.

According to the first aspect of the present invention, the rear holder is supported by the two front and rear plastic bands, and the curved spring portion is formed on the rear plastic band. For this reason, when the rear holder is pivotally dislocated on the front end of the front plastic band, the rear plastic band keeps the posture of the rear holder constant. Therefore, when the rear holder is pressed from the upper, the rear holder parallelly pivots to move obliquely forward, and the rear holder moves forward. For this reason, when the terminal is at the incomplete insertion position, the terminal is pressed to reach the normal engagement position in front of the terminal.

According to the second aspect of the present invention, since the rear holder is held while the terminal is pressed by the rear holder, removal of the terminal is prevented by the rear holder.

According to the third aspect of the present invention, when the rear holder is pressed from the upper, the rear holder moves obliquely forward by the curved spring portions of the front and rear plastic bands while the rear holder pivots with keeping its posture constant, and the rear holder presses the terminal at the incomplete insertion position to cause the terminal to reach the normal engagement position.

DESCRIPTION OF THE PREFERRED EMBODIMENTS

An embodiment of the present invention will be described below with reference to the accompanying drawings.

Figure 1:
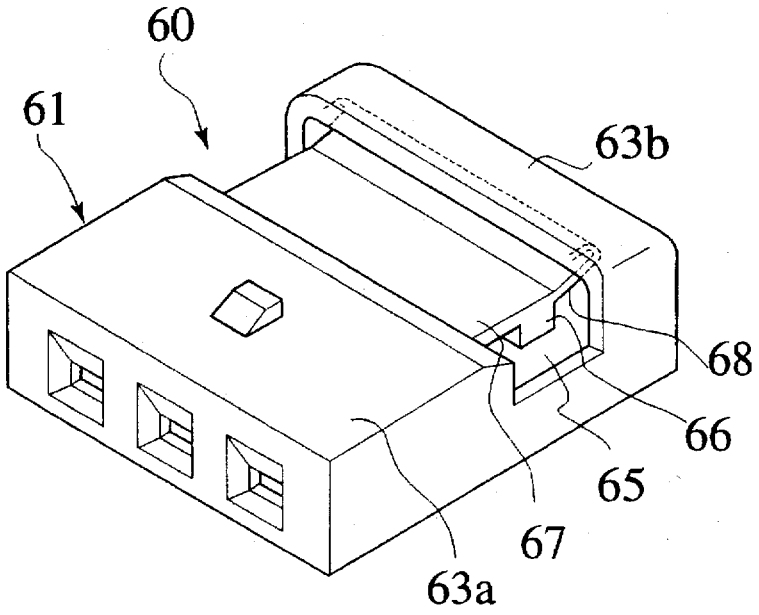
FIG. 1 is a perspective view showing the appearance of a connector according to an embodiment of the present invention when the connection is in an initial state.
Figure 2:
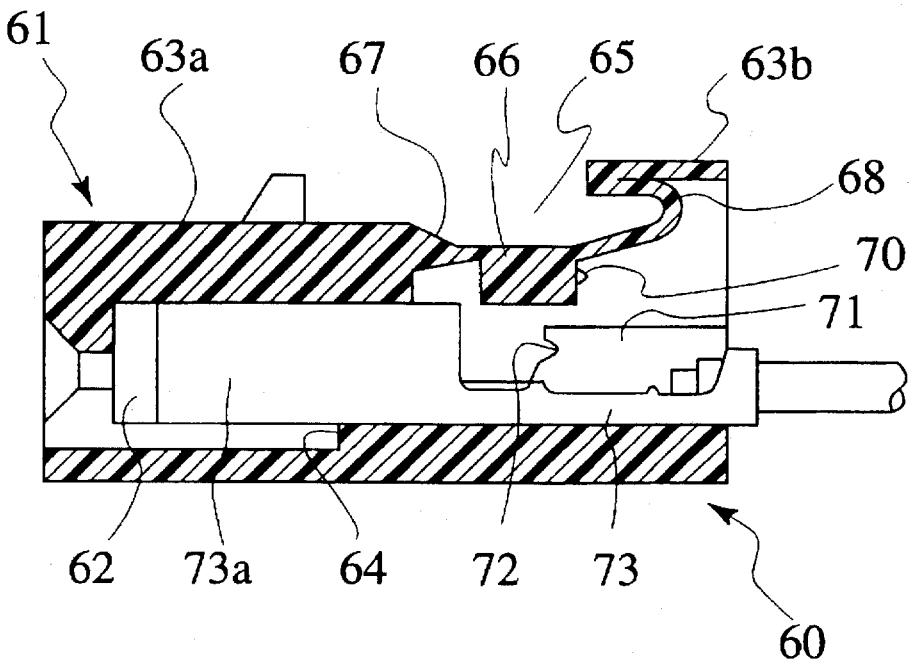
FIG. 2 is a sectional view showing main part of a state before actual engagement according to the embodiment of the present invention.
Figure 3:
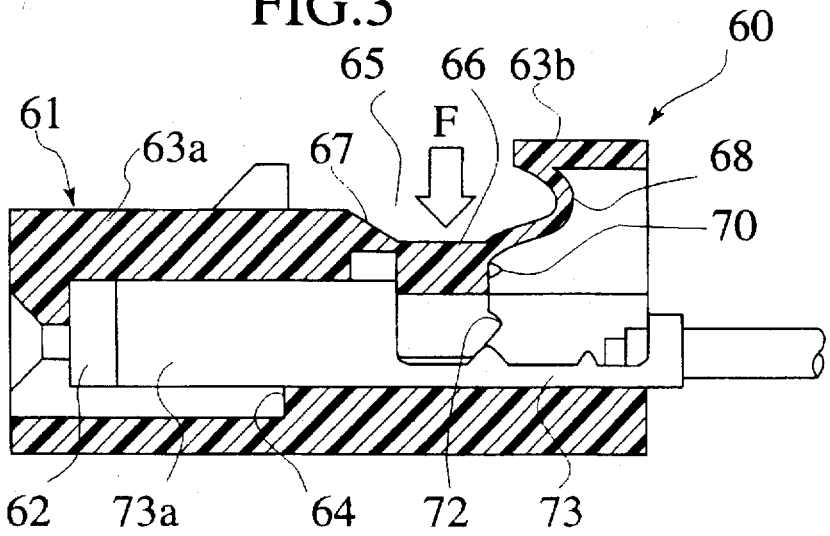
FIG. 3 is a sectional view showing a state in the middle of actual engagement according to the embodiment of the present invention.
Figure 4:
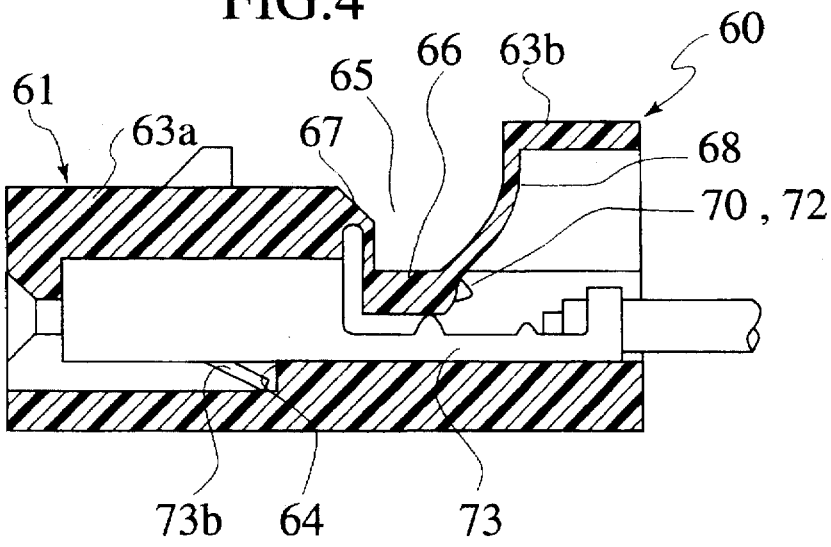
FIG. 4 is a sectional view showing a state of a state after actual engagement according to the embodiment of the present invention.

FIG. 1 is a perspective view showing an initial state of a connector according to the embodiment, FIG. 2 is a sectional view showing a state before actual engagement, FIG. 3 is a sectional view showing a state in the middle of actual engagement, and FIG. 4 is a sectional view showing a state after actual engagement.

In a connector 60, when a terminal 73 is inserted into a terminal storage chamber 62 arranged in a connector housing 61 from the rear, a lance **73*b* formed on the lower surface of the terminal 73 is engaged with an engagement step portion 64 formed on the inner surface of the terminal storage chamber 62, thereby preventing removal of the terminal 73**.

The upper wall of the connector housing 61 is constituted by a front-upper wall **63*a* and a rear-upper wall 63*b* arranged at a position higher than the front-upper wall 63*a* by one step, and a portion between the front-upper wall 63*a* and the rear-upper wall 63*b* is opened as an opening 65. A rear holder 66 for double-engaging the terminal 73 is arranged inside the edge of the opening 65. The rear holder 66 has a prism-like shape having a rectangular section, and the rear holder 66 is arranged in such a manner that its longitudinal direction is in the left-right direction of the connector housing 61. The front and rear edges of the front and rear edges of the rear holder 66 are integrally connected to the front and rear edges of the opening 65 through a front plastic band 67 and a rear plastic band 68, respectively. The connector housing 61 is a resin-molded product, and the rear holder 66 and the plastic bands 67 and 68** are integrally molded by a resin.

The plastic bands 67 and 68 are portions which are molded in the forms of thin sheets. The front plastic band 67 is formed in the form of a plate, and the rear plastic band 68 is curved in such a manner the rear plastic band 68 extends backward under the rear-upper wall **63*b*. The rear plastic band 68 is constituted as a curved spring portion having preferable elasticity as a whole. Due to the presence of the rear plastic band 68 formed as the curved spring portion, the front plastic band 67 is pivotally held on the front end of the front plastic band 67, and the posture of the rear holder 66** at this time can be kept constant.

An engagement projection (engagement portion) 70 is formed on the rear end surface of the rear holder 66. This engagement projection 70 is engaged with an engagement groove (engagement portion) 72 formed in a vertical wall 71 which partitions the terminal storage chamber 62, thereby holding the rear holder 66 at an actual engagement position.

The function of the present invention will be described below.

In this connector 60, when the terminal 73 is in an incomplete insertion state as shown in FIG. 2, and the rear holder 66 is pressed downward by a force F acting from the upper as shown in FIG. 3, the rear holder 66 is pivoted on the front end of the front plastic band 67 in such a manner that the rear holder 66 is pivoted in a circle having a radius in the forward/backward direction of the front plastic band 67.

In this case, since the rear plastic band 68 is formed like a curved spring, the rear plastic band 68 draws the rear holder 66 backward by a proper force. For this reason, the rear plastic band 68 functions such that the posture of the rear holder 66 is kept in a predetermined parallel state. Therefore, when the rear holder 66 is pressed from the upper, the rear holder 66 is pivoted with keeping its posture parallel, and the rear holder 66 moves obliquely forward. When the rear holder 66 moves forward, the front end of the rear holder 66 collides with the rear end (the engagement portion of the terminal 73 engaged with the rear holder 66) of a head portion 73*a* of the terminal 73 which is at an incomplete insertion position, and the terminal 73 is reliably pressed to reach a normal engagement position.

When the terminal 73 is pressed to reach the normal position, the lance 73*b* formed on the lower surface of the terminal 73 is actually engaged with the engagement step portion 64 of the terminal storage chamber 62. At the same time, the engagement projection 70 formed on the rear end surface of the rear holder 66 is engaged with the vertical wall 71 of the connector housing 61, thereby locking the rear holder 66. Therefore, removal of the terminal 73 is prevented from the rear holder 66. In this manner, double engagement, i.e., engagement by the lance 73*b* and engagement by the rear holder 66, is performed.

According to the connector 60, since the rear holder 66 is arranged inside the opening 65, the rear holder 66 does not extend outside. Therefore, when the connector is handled in a sub-assembling state, other members are not caught on the rear holder 66.

Figure 5:
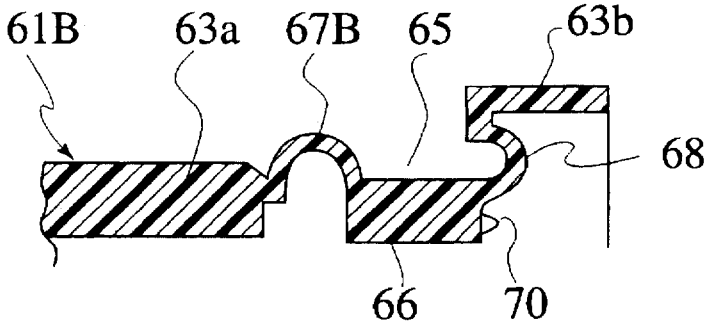
FIG. 5 is a sectional view showing main part of another embodiment of the present invention.

The above embodiment describes a case wherein only the rear plastic band 68 is formed like a curved spring. However, as shown in FIG. 5, a front plastic band 67B formed in a connector housing 61B may be formed like a curved spring. In this case, when the rear holder 66 is pressed from the upper, the rear holder 66 pivotally moves obliquely forward with keeping its posture constant, and the terminal 73 at an incomplete insertion position is pressed to reach the normal engagement position.

As each of the above embodiments, each of the plastic bands 67B and 68 need not be formed like a curved spring as a whole, and a curved spring portion may be formed as a part of each of the plastic bands 67, 67B, and 68.

What is claimed is:

1. A connector comprising:

an opening formed in an outer peripheral wall of a connector housing facing a terminal storage chamber;

a rear holder arranged in said opening and inserted into said terminal storage chamber to be engaged with an engagement portion of a terminal inserted into said terminal storage chamber from a rear thereof so as to prevent removal of said terminal to the rear; and front and rear bands for connecting front and rear edges of said rear holder to front and rear edges of said opening, wherein a curved spring portion for pivotally holding said rear holder on a front end of said front band while keeping a posture of said rear holder constant is formed on said rear band.

2. A connector according to claim 1, wherein when said rear holder is pressed to reach a predetermined position in said terminal storage chamber, an engagement portion for holding said rear holder is arranged at the predetermined position.

3. A connector according to claim 1 or 2, wherein a curved spring portion is formed on said front band.

4. A connector according to claim 1, wherein said front and rear bands are plastic.

* * * * *